United States Patent [19]

Joyce

[11] Patent Number: 5,065,876

[45] Date of Patent: Nov. 19, 1991

[54] CHILD-PROOF CONTAINER AND FLIP-TOP CLOSURE FOR DRY OR FOR LIQUID CONTENTS

[75] Inventor: Michael Joyce, Rockaway, N.J.

[73] Assignee: Joyce Molding Corp., Rockaway, N.J.

[21] Appl. No.: 445,416

[22] Filed: Dec. 4, 1989

[51] Int. Cl.[5] ..... B65D 55/02

[52] U.S. Cl. ..... 215/206; 215/216; 215/225; 222/153; 222/556

[58] Field of Search ..... 215/206, 216, 224, 225; 222/153, 556, 498

[56] References Cited

U.S. PATENT DOCUMENTS

| | | | |
|---|---|---|---|
| 3,623,622 | 11/1971 | Sullivan | 215/216 X |
| 3,848,780 | 11/1974 | Stull | 215/211 |
| 3,877,598 | 4/1975 | Hazard | 215/225 X |
| 4,022,352 | 5/1977 | Pehr | 215/224 X |
| 4,629,081 | 12/1986 | McLaren | 215/206 |
| 4,718,567 | 1/1988 | La Vange | 215/216 |
| 4,759,455 | 7/1988 | Wilson | 215/206 |
| 4,776,475 | 10/1988 | La Vange | 215/206 X |
| 4,941,580 | 7/1990 | Julian | 215/225 X |

FOREIGN PATENT DOCUMENTS

| | | | |
|---|---|---|---|
| 2158048 | 11/1985 | United Kingdom | 215/216 |

*Primary Examiner*—Stephen Marcus
*Assistant Examiner*—Vanessa M. Roberts
*Attorney, Agent, or Firm*—Elliot M. Olstein; Susan A. Capello

[57] ABSTRACT

A child-proof container and a closure for selectively opening and closing the container. The hollow container has at its upper end a dispensing opening. The closure has a body member and a flip-top cap member attached by a hinge to the body member for movement between open and closed positions. The body member is supported and locked on the container to permit rotational movement of the body member on the container. The container has an annular locking rib for releasable locking engagement with a locking bead on the cap member to permit unlocking of the cap member from the container only when the body member is rotated to an unlocking position with respect to the container, whereby the cap member may be moved from a closed to an open position to permit dispensing of contents from the container. The container and the closure are provided with corresponding indicia to indicate the precise rotational alignment of the container and the body member to permit unlocking of the cap member from the container. The container and closure are constructed in different embodiments for dry contents and for liquid contents. The container is made of essentially rigid materials. The closure is made of essentially semi-flexible materials. The container and closure are provided with a diverter which requires precise alignment of the closure with respect to the container in order to open the container. The container and closure are provided with a diverter which automatically locks the container upon closing of the closure with respect to the container.

22 Claims, 4 Drawing Sheets

CHILD-PROOF CONTAINER AND FLIP-TOP CLOSURE FOR DRY OR FOR LIQUID CONTENTS

BACKGROUND OF THE INVENTION

This invention relates to a child-proof container and a flip-top closure and, more particularly to child-proof devices for selectively opening and closing a container for dry or for liquid contents.

The POISON PREVENTION PACKAGING ACT in 1970 required special packaging to protect children from serious personal injury or illness resulting from handling, using or ingesting household substances which may be toxic or dangerous. Accordingly, various types of child-proof containers and closures have been developed.

The present invention relates to a type of child-proof container and a flip-top closure which requires placement of the closure in a specific rotational position relative to the associated container in order to open the container, but permits locking of the closures to the container in any other rotational position relative to the container.

It has been previously recognized that the utility of a child-proof closure for a container having dry contents can be enhanced by constructing a one-piece closure molded of a flip-top lid connected to a base member. The connection assures cooperation of the flip-top lid with the base member and eliminates loss of the lid after it has been disengaged from the base member.

Various structures have been utilized in the prior art in order to obtain the foregoing attributes. Examples of closures for dry contents containers of this type are found in U.S. Pat. No. 3,848,780 and in U.S. Pat. No. 4,718,567.

U.S. Pat. No. 3,848,780 issued Nov. 19, 1974, discloses a safety cap of a tubular cap body having a top discharge opening, a captive closure cap adapted to fit over the opening of the cap body so as to seal the same, and cooperative yielding retainer means on the cap body and cap tending to hold the latter firmly in a closed, sealing position on the cap body. The cap is held captive on the body by means of a flexible hinge wedge structure which enables the cap to be swung from a sealing position to an open position.

The cap body and cap have cooperative detent lugs which can by-pass one another when the cap is turned, to yieldably retain the cap in a position wherein its lifting tab is out of registration with the interference lug on the cap body, such that the user's finger can then be easily applied to the underside of the lifting tab for the purpose of removing the cap.

U.S. Pat. No. 4,718,567 issued Jan. 12, 1988, discloses a child-resistant closure having a cap base member and a cap lid member. The cap base member is provided with a dispensing opening, a slot and a cap locking bead adapted to engage a container locking bead. The cap lid member is provided with a locking prong adapted to be received within the slot when the cap lid member assumes a closed position. The cap lid member is adapted to thereafter to assume the open position by a user manually rotating the cap base member with respect to the neck so as to bring the slot into alignment with an interruption in a container locking bead and then manually moving the cap lid member away from the cap base member so as to withdraw the locking prong from the slot, thereby opening the container.

Also in the prior art, closures of this type have been utilized for containers containing liquid contents. Examples of such closures are found in U.S. Pat. No. 4,022,352 and U.S. Pat. No. 4,776,475.

U.S. Pat. No. 4,022,352 issued May 10, 1977, discloses a cover and safety closure structure for a container having a flowable material therein including a cap member integral with or mounted on the container and having a material dispensing aperture in a top wall of the cap member. A closure member is hingably mounted on the cap member and is movable between an open position and a position in covering relation with and closing the material dispensing aperture. A latch member extends from the closure member and the latch member and cap member have cooperative portions engageable one with the other for retaining the closure member in covering relation with and closing the material dispensing aperture in the cap member. To move the closure member to the open position, it is first necessary to move a portion of the closure member toward the cap member against resistance of a resilient member or members and second to separate the cooperating portions on the latch member and the cap member.

U.S. Pat. No. 4,776,475 issued Oct. 11, 1988, discloses a child resistant dispensing closure of the type comprising a cap member and a spout member. The cap member is provided with an exterior skirt, a top surface having an elongated groove formed therein, and an interior skirt. The interior skirt is provided with a cap locking bead adapted to engage a container locking bead provided on the neck of a container for rotatably mounting the cap member on the neck of the container. The elongated groove has a dispensing opening and an open area formed therein, and the interior skirt is provided with an interruption at the location of the open area so as to maintain the area unobstructed. The container locking bead is also provided with the interruption. The spout member is adapted to be mounted at one end in the elongated groove for rotation with respect to the cap member. The spout member is provided with a depending locking prong adapted for insertion into the open area for closure. The spout member is adapted to assume an open position wherein the spout member is oriented vertically with respect to the cap member and the dispensing opening and longitudinal passage are in communication.

There is another problem with previous closures wherein a locking bead is manually rotated into alignment with an interruption in a container locking bead: i.e. an adult, after alignment of the bead and interruption for opening the closure, may forget that after closing the closure the bead and interruption are still in alignment for opening by a child. After closing, it is necessary to manually rotate the locking bead out of alignment with the interruption in order to lock the closure and container from immediate, easy opening by a child.

While the attributes of the foregoing closures are numerous, the need exists to provide flip-top closures with a more effective means for preventing unwanted access to potentially harmful contents of the container with which the closures are associated. Typically, the closure is made of semiflexible material. Accordingly, there is a need to preclude undesirable deformation of the closure member whereby the cap can be disassociated from the base member.

Previous attempts to provide flip-top closures of a child-proof character have often resulted in constructions, which, due to their complexity, were prohibitively expensive to manufacture for commercial utilization. Additionally, complicated structures often rendered the closures difficult to operate, even by an adult, requiring highly complicated manipulations, and/or considerable finger strength.

The present invention addresses the foregoing problems and deficiencies by providing a combination of a child-proof container for dry contents or for fluid contents with a flip-top closure for selectively opening and closing the container. The flip-top closure has a body member and a closure or cap member both of which are locked separately with respect to the neck of the container in the fully closed position. By manual rotation of the flip-top closure from the lock position with respect to the associated container so as to assume a specific aligned position, the closure or cap member can be disengaged from the neck of the container to permit access to the contents thereof.

The unlocking position of the top member with respect to the body member of the closure is extremely limited, with all other positions of the closure being locked. Unlocking is achieved only by exact rotation into alignment of the closure with respect to the neck of the container. Further, both the body member and the top member of the flip-top closure are positively and separately locked with respect to the container. This effectively precludes the possibility that a child could deform and thereby open the top member from the body member. Accordingly, a typical child is unlikely to engage in the sophisticated steps needed in order to rotate, to align and to open the closure. Furthermore, the separate locking of both the top member and the body member to the container requires more physical strength in deformation of the members then is required in prior art devices. Accordingly, it is unlikely that a typical child will possess the strength required to deform and to open the child-proof container and flip-top closures of the present invention.

SUMMARY OF THE INVENTION

It is an object of the present invention, therefore, to provide a novel combination of a child-proof container with a flip-top closure for selectively opening and closing said container having either dry or liquid contents.

Another object of the present invention is to provide a flip-top closure with a base member and a top member, both cooperating in a sophisticated manner with the container so as to resist separation of the top member from the body member by a child.

A further object of the present invention is to provide a child-proof container and a flip-top closure which are not unduly complicated and expensive to manufacture.

Yet another object of the present invention is to provide a novel child-proof container and a flip-top closure for use with dry or liquid contents.

A still further object of the present invention is to provide a child-proof container and closure with automatic locking means upon closing of the closure with respect to the container.

These and other objects not enumerated are achieved by the novel child-proof container and flip-top closure of the present invention.

BRIEF DESCRIPTION OF THE DRAWINGS

A more complete understanding of the child-proof container and flip-top closures of the present invention may be had from the following detailed description thereof particularly when read in the light of the accompanying drawings, wherein.

DETAILED DESCRIPTION OF THE PREFERRED EMBODIMENTS

Figure 1:
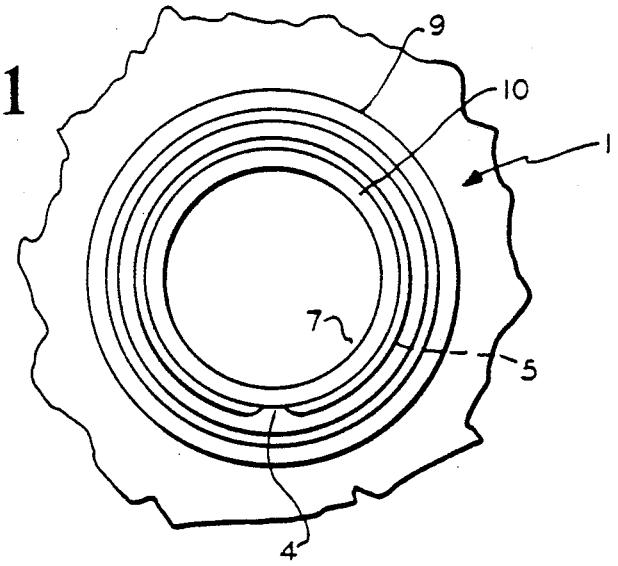
FIG. 1 is a top plan view of the child-proof container of the present invention.
Figure 2:
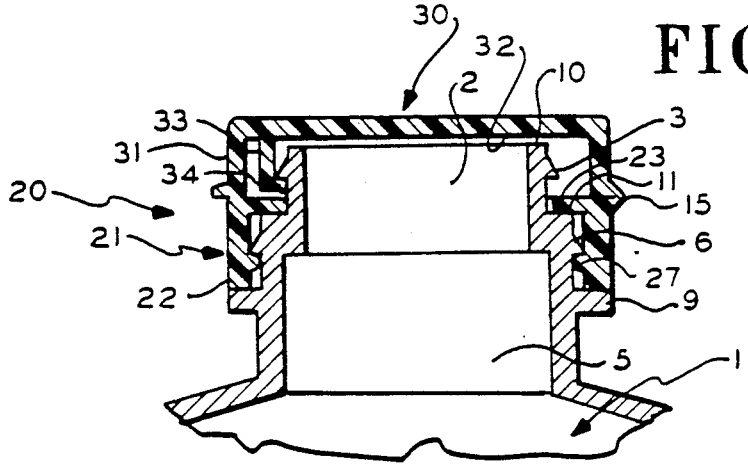
FIG. 2 is a side sectional view of the child-proof container of FIG. 1 with the dry contents flip-top closure thereon locking the container.
Figure 3:
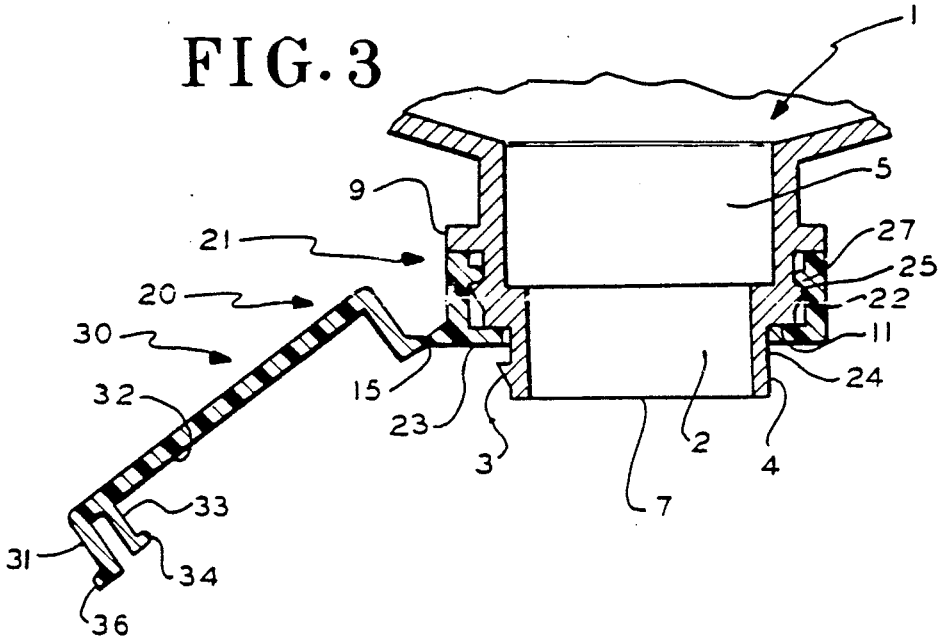
FIG. 3 is a side sectional view of the inverted child-proof container and flip-top closure of FIG. 2, with the flip-top closure rotated into alignment and opened from the container.

A preferred embodiment of the child-proof container and dry contents flip-top closure is best described in the context of FIGS. 1–3.

The child-proof container is generally indicated by the reference no. 1. Container 1 can be a hollow bottle with a narrow, circular neck 2 at the upper portion. At the top of the neck 2 is a circular rim 10 defining the dispensing opening 7 of the container 1. Below the rim 10 is a radially protruding top locking rib 3 encircling the neck 2 except for a short interruption 4. Below the top locking rib 3 and the neck 2 of the bottle 1 is an enlarged neck 5. At the top of the enlarged neck 5 is a body locking rib 6 radially protruding and completely encircling the enlarged neck 5. The neck 2 and the enlarged neck 5 are connected by a bottle shoulder 11.

The flip-top closure 20 has a body member 21 and a top member 30. The body member 21 has an annular body skirt 22, which covers the body locking rib 6. The interior of the body skirt 22 has an annular groove 25 with a continuous inwardly extending bead 27 which locks under the outwardly extending body locking rib 6. The body skirt 22 is connected at its top to a body cover 23, which has a circular cross section and a central bottle opening 24 therein. The cover 23 rests on the bottle shoulder 11 after the bottle opening 24 passes over the rim 10 and the neck 2 of the bottle 1.

The top member 30 has a downwardly projecting lug 33 which is attached to the interior of the cover 32 and within the annular top skirt 31. The lug 33 has an axially inwardly projecting locking bead 34 which is formed so as to pass through the interruption 4 of the top locking rib 3 of the bottle 1. When the locking bead 34 has passed through the interruption 4 the closure 20 can be rotated so that the top member 30 is locked to the bottle 1 by the engagement of the top locking rib 3 with the locking bead 34.

Because of the semi-flexibility of the top lug 33 the bottle 1 can also be locked by pushing the top locking bead 34 over the top locking rib 3 without the necessity of rotating the closure 20 so that the locking bead 34 must pass through the interruption 4.

When the bottle 1 is locked, the inner surface of the top lid 32 is in contact with the bottle rim 10 so as to seal the contents of the bottle 1. The top member 30 is further provided with a lifting tab 36 on the exterior of the top skirt 31. Said lifting tab 36 projects outwardly and has the same radial location on the bottom of the top skirt 31 as the locking bead 34 has on the lug 33.

The operation of the child-proof container and the flip-top dry contents closure is shown in FIG. 3. The bottle 1 has been inverted so that the dispensing opening 7 is downward. The closure 20 has been rotated on the bottle 1 so that the locking bead 34 has been aligned and passed through the interruption 4 of the top locking rib 3 of the bottle 1. This permits the user to lift the tab 36 away from the dispensing opening 7 so as to move the top member 30 away from the body member 21 along the hinge 15 which is integrally molded to the top member 30 and to the body member 21. This provides access by the user to the dry contents of the bottle 1 through the dispensing opening 7.

Below the body locking rib 6 is a radially protruding bottle lip 9 completely encircling the enlarged neck 5. The bottle lip 9 and the body member 21 form a continuous smooth surface which prevents lifting of the body member 21 by a child trying to open the bottle 1.

Figure 4:
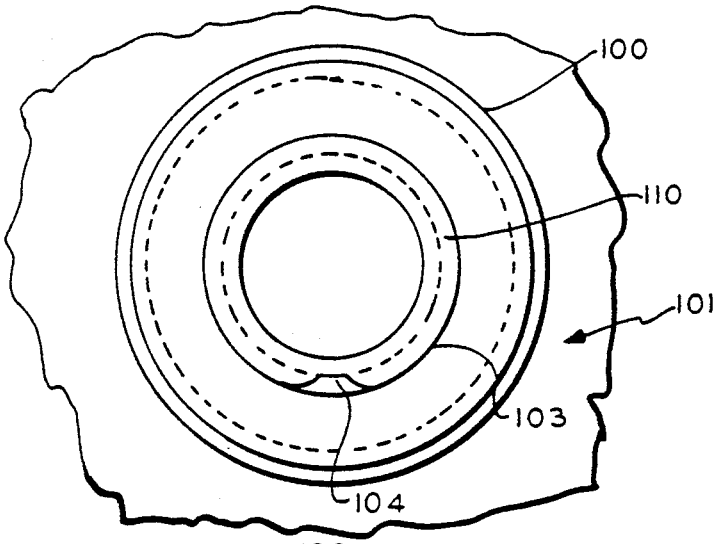
FIG. 4 is a top plan view of the child-proof container of the present invention.
Figure 5:
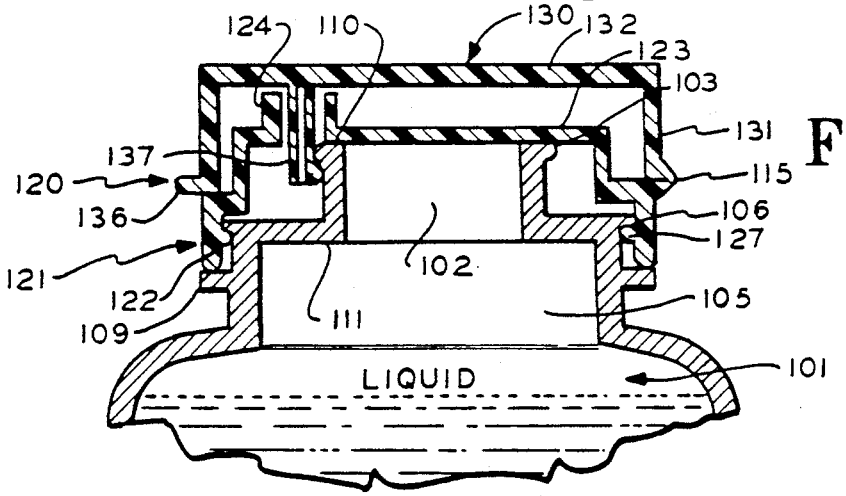
FIG. 5 is a side sectional view of the child-proof container of FIG. 4 with the liquid contents flip-top enclosure thereon.
Figure 6:
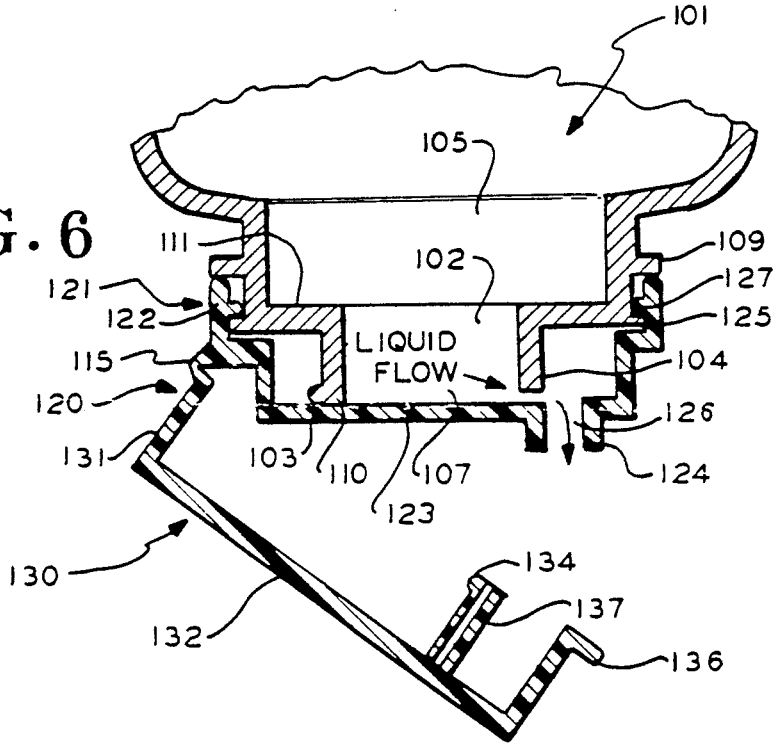
FIG. 6 is a side sectional view of the inverted child-proof container and flip-top closure of FIG. 5, with the flip-top closure rotated into alignment and opened from the container.

A preferred embodiment of the child-proof container and liquid contents flip-top closure is shown in FIGS. 4–6. The container, generally referred to as 101, is a bottle with a narrow neck 102 at its upper portion. The neck 102 has a circular dispensing opening 107 defined by a bottle rim 110 at the top of the bottle 101. On the outside of the neck 102 and below the rim 110 is a radially protruding top locking rib 103 encircling the neck 102 except for a short interruption 104. Below the top locking rib 103 is an enlarged neck 105 having a greater circumference then the neck 102. The neck 102 and the enlarged neck 105 are connected by a bottle shoulder 111. At the top of the enlarged neck 105 is a radially protruding body locking rib 106 completely encircling the enlarged neck 105. Below the body locking rib 106 is a radially protruding bottle lip 109 completely encircling the enlarged neck 105.

The bottle 101 is closed in FIG. 5 with the flip-top closure, generally referred to as 120. The closure 120 has a body member 121 with an annular body skirt 122 circumferentially encircling the enlarged neck 105 of the bottle 101. At the top of the body member 121 is a circular body cover 123 attached to the body skirt 122. The cover 123 has a central bottle opening 124 which passes over the neck 102 of the bottle 101. The cover 123 also has a circular discharge opening 126 located on the cover 123 between the dispensing opening 107 and the body skirt 122. The interior of the body skirt 122 has on its inner surface a circumferential body groove 125 with a continuous inwardly extending bead 127 adapted to mate in snapping engagement with the body locking rib 103 of the bottle 101.

The top member 130 has a circular top lid 132 connected to an annular top skirt 131 encircling the dispensing opening 107 of the bottle 101. When the flip-top closure 120 is closed onto the bottle 101 the top lid 132 seals the rim 110 of the bottle 101. Beneath the top lid 132 is a sealing plug 137 which is connected to the interior of and projecting downward from the top lid 132. The sealing plug 137 has a circular cross section which mates in frictional engagement with the discharge opening 126 in the body cover 123. The sealing plug 137 mates in frictional engagement with the discharge opening 126 in the body cover 123 at the space between the neck 102 and the enlarged neck 105 just above the bottle shoulder 111. The sealing plug 137 has an inwardly radial projecting locking bead 134 which is formed so as to pass through the discharge opening 126 and the interruption 104 when the sealing plug 137 is perfectly aligned with the interruption 104 of the top locking rib 103 of the bottle 101. After passing through the discharge opening 126 the locking bead 134 on the sealing plug 137 passes through the interruption 104. Thereafter the sealing plug 137 is maintained in touching contact with the top locking rib 103 as the closure 120 is further rotated, thereby sealing the closure 120 to the bottle 101 so as to keep the liquid contents within the bottle 101.

Because of the semi-flexibility of the sealing plug 137, the bottle 101 can also be locked by pushing the top locking bead 134 over the top locking rib 103 without the necessity of rotating the closure 120 so that the top locking bead 134 must pass through the interruption 104.

When the bottle 101 is locked, the inner surface of the cover 123 is in contact with the bottle rim 110 so as to seal the contents of the bottle 101.

The operation of the child-proof container and liquid contents flip-top closure is shown in FIG. 6. The bottle 101 has been inverted and the closure 120 has been rotated so that the locking bead 134 of the sealing plug 137 has been exactly aligned with the interruption 104 of the top locking rib 103 on the bottle 101. This permits the user to exert pressure on the lifting tab 136 to move the sealing plug 137 out of the discharge opening 126. The weight of the liquid contents in the bottle neck 102 causes the semi-flexible top lid 132 to flex away from the bottle rim 110 which enables the liquid to pass through the bottle dispensing opening 107 and out through the discharge opening 126 as indicated by the arrows in FIG. 6. After a sufficient amount of the liquid contents of the bottle 101 has been dispensed, the sealing plug 137 is moved back within the discharge opening 126 and through the interruption 104 so as to seal the bottle 101. Thereafter the closure 120 is rotated about the bottle so that the locking bead 134 remains in contact with the top locking rib 103 of the bottle 101 until further liquid dispensing is required.

The above embodiments of the child-proof container and flip-top closures can be provided with indicia on both the container and on the flip-top closures to indicate the precise alignment of the locking bead 34 and 134 with the interruption 4 and 104, respectively. By alignment of the appropriate indicia the user is enabled to exert pressure on the tab 36 and 136 so as to move the top member 30 and 130 away from the body member 21 and 121 along the hinge 15 and 115, respectively.

It is a feature of the present invention for both the dry and liquid contents flip-top closures to provide a bottle lip 9 and 109 on the bottle 1 and 101 so as to prevent access by the finger nail of the child to remove the body member 21 and 121 from its snapping engagement with the body locking rib 6 and 106, respectively.

Figure 7:
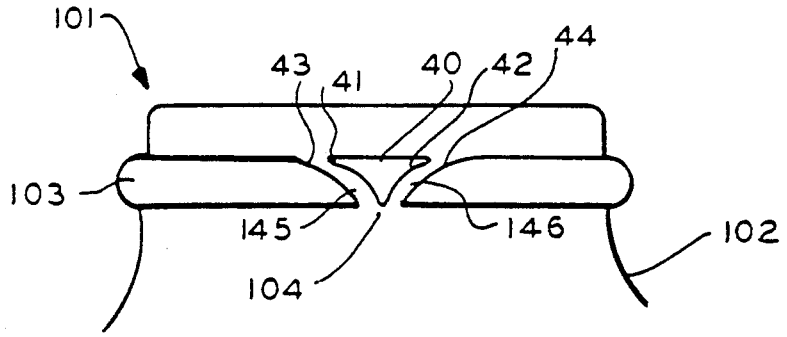
FIG. 7 is a side view of the preferred embodiment of the locking feature of the present invention.
Figure 8:
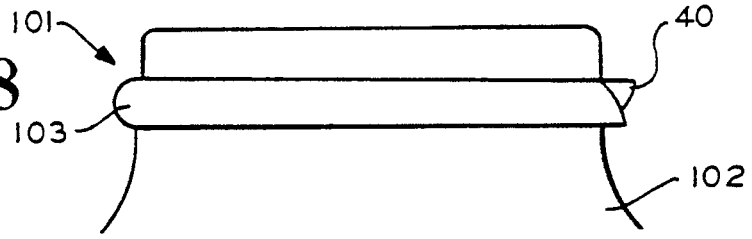
FIG. 8 is a side view of FIG. 7 along lines 8—8.

Referring now to FIGS. 7-8 there is shown a preferred embodiment of the novel automatic locking and precise alignment opening features of the present invention. The container 101 has a radially protruding locking rib 103 encircling the neck 102. The locking rib 103 has an interruption 104 with a diverter 40 located centrally within the interruption 104. The diverter 40 has a generally inverted isosceles triangle configuration with internally curved sides 41, 42 which are spaced apart from matched externally curved upward sides 43, 44 of the interruption 104 to form curved tracks 145, 146 respectively for the locking bead 34. The spacing apart of the matched curved sides 41, 43 and 42, 44, respectively to form the tracks 145, 146 is by slightly more than the width of the locking bead 34 which is connected by the lug 33 to a closure (not shown).

Figure 9:
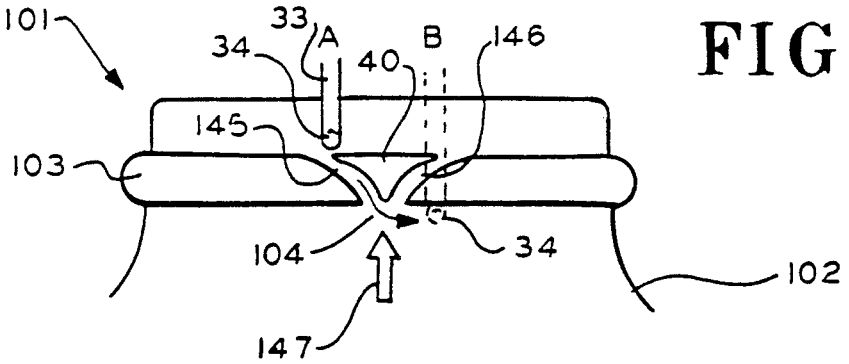
FIG. 9 is a side view of the operation of the automatic locking feature of the present invention.

Referring now to FIG. 9 there is shown the operation of the novel automatic locking and precise alignment opening features of the present invention. The diverter 40 assures that the closure can only be opened from the container 101 when the locking bead 34 is precisely aligned with the arrow 147 embossed on the container 101 below the locking rib 103 so that the locking bead 34 may be moved upward and passed through either of the curved tracks 145 or 146. However, the diverter 40 also prevents the opened closure from being closed until the locking bead 34 is aligned above the locking rib 103 at either positions A or B so as to permit downward passage of the locking bead 34 through either track 145 or 146. The momentum of the axial and rotational forces necessary to bring the locking bead 34 down through either track 145 or 146 from positions A or B, respectively above the locking rib 103, automatically moves or diverts the locking bead 34 to an opposite position B or A, respectively, below the locking rib 103, from which positions B or A the container cannot be reopened until the locking bead 34 is again moved back into precise alignment with the arrow 147 embossed on the container 101 below the locking rib 103. Therefore, it can be seen that the diverter 40 provides automatic locking and requires precise alignment opening of the locking bead 34 with respect to the container 101 because when the locking bead 34 is moved downward through either track 145 or 146 to below the locking rib 103 the locking bead 34 is in a position from which it cannot be reopened until the user has moved the locking bead 34 again into precise alignment with the arrow 147 indicating the exact bottom of the diverter 40. These automatic locking and precise alignment opening features assure that a child cannot open a container that has just been closed by an adult and left within reach of the child.

Figure 10:
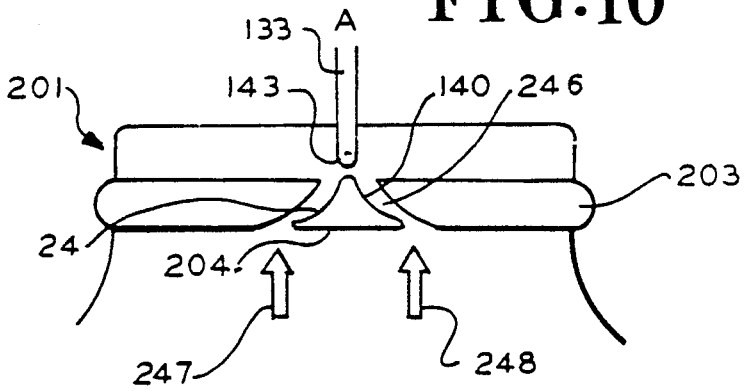
FIG. 10 is a side view of an alternative embodiment of the automatic locking feature of the present invention.

An alternative embodiment of the novel automatic locking and precise alignment opening features of the present invention are shown in FIG. 10 wherein the diverter 140 has a generally isosceles triangle configuration with the base downward and located centrally within the interruption 204 so as to form passages 245 and 246 in the interruption 204 between the diverter 140 and the locking rib 203. The container locking bead 134 on the lug 133 can only move downward to close the container 201 when the locking bead 134 is moved to position A above the locking rib 206. The momentum of the axial and rotational forces necessary in closing the closure with respect to the container 201 automatically carries the locking bead 134 beyond the embossed arrows 247 or 248 on the container 201 below the locking rib 203. The container 201 can then be reopened only by precisely realigning the locking bead 134 at the position of either arrow 247 or 248 for opening the closure with respect to the container 201.

Figure 11:
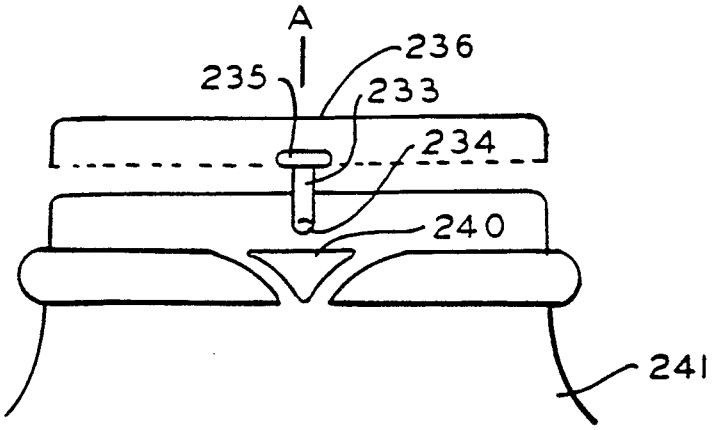
FIG. 11 is a partially exploded side view of another alternative embodiment of the automatic locking feature of the present invention.
Figure 12:
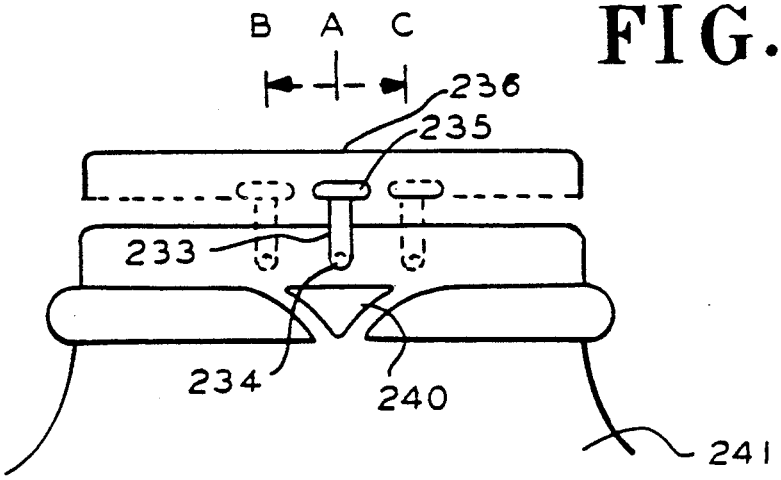
FIG. 12 is a partially exploded side view illustrating the operation of the alternative embodiment of FIG. 11.

Another alternative embodiment of the novel automatic locking and precise opening features of the present inventions are shown in FIG. 11 wherein the diverter 240 has a generally isosceles triangle configuration with the base upward. The locking bead 234 is connected by the locking lug 233 to a raised boss 235 on the closure lid 236. In the A position shown in FIG. 11, the locking bead 234 can only be raised upward to open the container 241, and the locking bead 234 cannot be lowered to close the container 241 until, as shown in FIG. 12, the locking bead 234 on the raised boss has been turned or realigned by rotation to either side positions B or C. In order to prevent the closed container from being opened by a child, the adult user of the container must rotate the locking bead 234 below the raised boss 235 so that it is not aligned in Position A.

Position A can be indicated by raised arrows (not shown) on both the container 241 and on the raised boss 235. The opening instructions to the adult user of the container 241 can be imprinted on the top surface of the closure lid 236:

"ALIGN THE ARROWS TO OPEN; THEN TURN OR MISALIGN THE ARROWS IN ORDER TO CLOSE"

Since the opening instructions and manipulations are too advanced for young children, the child-proof container of the present invention presents significant impediments to opening by young children.

The child-proof container of the present invention can be made from essentially rigid materials such as glass, plastics, etc. The closures of the present invention can be made from essentially semi-flexible materials such as plastic.

While the present invention has been described with a degree of particularity in connection with the preferred embodiments, it should be understood the variations and modifications will be obvious to those skilled in the art without departing from the scope of the present invention as defined in the appended claims.

The foregoing disclosure and drawing are merely illustrative of the principles of this invention and are not to be interpreted in a limiting sense. It is to be understood that the present invention is not limited to the exact details of construction shown and described because obvious modifications will occur to a person skilled in the art.

What is claimed is:

1. A child-proof container having a dispensing opening; a closure for closing the dispensing opening comprising a body member and a cap member movably attached to said body member for movement between open and closed positions; a first locking means on said container for supporting and locking said body member to said container to permit rotational movement of said body member on said container; and a second locking means on said container and spaced from said first locking means for releasably locking said cap to said container to permit unlocking of said cap from said container only when the body member is rotated to an unlocking position with respect to the container; whereby said cap may be moved from a closed to an open position to permit dispensing of contents from the container.

2. The child-proof container and closure according to claim 1, wherein corresponding indicia are provided on said container and on said closure to indicate rotational alignment of said container and of said body member to permit unlocking of said locking means.

3. The child-proof container and closure according to claim 1, wherein said container further includes means in contact with said body member to prevent a child from having access to said body member for disengagement of said body member from said container by lifting of said body member.

4. The child-proof container and closure according to claim 1, herein the means for supporting and locking said body member to said container is a radially protruding body locking rib encircling said container below the dispensing opening, said body rib supporting and lockably engaging an inwardly extending bead within an annular skirt on said body member and encircling said container.

5. The child-proof container and closure according to claim 4, wherein the rib on said container and the bead on said body member are in continuous locking engagement.

6. The child-proof container and closure according to claim 1, wherein the locking means for releasably locking said cap to said container is a radially protruding top locking rib encircling said container below the dispensing opening except for a short interruption, and said cap has a downwardly projecting lug with an axially inwardly projecting cap locking bead which is formed so as to pass through the interruption, whereby relative movement of said cap and said container causes releasable locking engagement of said top locking rib and said cap locking bead.

7. The child-proof container and closure according to claim 1, wherein said dispensing opening has a circular rim and the cap member has an internal circular cover, whereby locking said cap to said container causes sealing engagement between said cover and said rim.

8. The child-proof container and closure according to claim 1, wherein said container is made of essentially rigid material.

9. The child-proof container and closure according to claim 1, wherein said closure is made of essentially semi-flexible material.

10. The child-proof container and closure according to claim 1, wherein said movable attachment between said cap member and said body member is a hinge.

11. A child-proof container having a dispensing opening and a closure for closing the dispensing opening, said closure movably attached to said container for movement between opened and closed positions; comprising:

means for supporting said closure to said container to permit rotational movement of said closure on said container;

locking means for releasably locking said closure to said container to permit unlocking of said closure from said container only when said closure is rotated to an unlocking position with respect to said container, whereby said closure may be moved from a closed to an open position to permit dispensing of contents from the container; and means for automatically rotating said closure to a locking position upon closing of said closure with respect to said container.

12. The child-proof container and closure according to claim 11, wherein corresponding indicia are provided on said container and on said closure to indicate rotational alignment of said container and of said closure to permit locking or unlocking of said locking means.

13. The child-proof container and closure according to claim 11, wherein the means for supporting said closure to said container is a radially protruding rib encircling said container below the dispensing opening, and said closure has an inwardly projecting lug formed with an axially inwardly projective locking bead which rotatably engages said rib.

14. The child-proof container and closure according to claim 13, wherein the locking means for releasably locking said closure to said container is a short interruption in said rib, whereby passing said locking bead through the interruption and relative movement of said closure and said container causes releasable locking engagement of said rib and said bead.

15. The child-proof container and closure according to claim 14, wherein the means for automatically rotating said closure to a locking position is a diverter located within the interruption, whereby the closure can only be opened when the locking bead is in a precisely aligned opening position, and the closure can only be closed when the locking bead is in another aligned closing position.

16. The child-proof container and closure according to claim 15, wherein the form of the diverter converts the momentum of the axial and rotational forces used to close the closure so as to move the locking bead to an unaligned position which prevents opening of the closure until the locking bead is moved to a another precisely aligned position.

17. The child-proof container and closure according to claim 16 wherein the diverter has the form of a triangle.

18. The child-proof container and closure according to claim 17 wherein the diverter has the form of a triangle with inwardly curved sides.

19. The child-proof container and closure according to claim 17 wherein the diverter has the form of an isosceles triangle.

20. The child-proof container and closure according to claim 11, wherein said container is made of essentially rigid material.

21. The child-proof container and closure according to claim 11, wherein said closure is made of essentially semi-flexible material.

22. A child-proof container having a dispensing opening; a closure for closing the dispensing opening comprising a body member and a cap member movably attached to said body member for movement between open and closed positions; means for supporting and locking said body member to said container to permit rotational movement of said body member on said container; and locking means for releasably locking said cap to said container to permit unlocking of said cap from said container only when the body member is rotated to an unlocking position with respect to the container; whereby said cap may be moved from a closed to an open position to permit dispensing of contents from the container; wherein said container further includes means in contact with said body member to prevent a child from having access to said body member for disengagement of said body member from said container, by lifting of said body member.

* * * * *